US006481118B1

(12) United States Patent
De Vroome

(10) Patent No.: US 6,481,118 B1
(45) Date of Patent: Nov. 19, 2002

(54) DRYER WITH INTEGRATED COOLING UNIT AND METHOD OF OPERATION

(75) Inventor: Clemens Johannes Maria De Vroome, BB Beugen (NL)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/556,414

(22) Filed: Apr. 24, 2000

(30) Foreign Application Priority Data

Apr. 23, 1999 (DE) ..... 199 18 669

(51) Int. Cl.[7] ..... F26B 3/00

(52) U.S. Cl. ..... 34/461; 34/464; 34/508; 34/66; 34/629; 34/630; 34/639; 101/424.1; 101/488

(58) Field of Search ..... 34/67, 66, 623, 34/629, 630, 639, 643, 444, 459, 461, 464, 488, 508; 101/424.1, 487, 488

(56) References Cited

U.S. PATENT DOCUMENTS

| | | | | |
|---|---|---|---|---|
| 2,731,732 A | | 1/1956 | Harris et al. | |
| 4,010,550 A | * | 3/1977 | Freze | 26/18.5 |
| 4,462,169 A | | 7/1984 | Daane | |
| 4,575,952 A | | 3/1986 | Bodenan et al. | |
| 5,333,395 A | | 8/1994 | Bulcsu | |
| 5,471,847 A | * | 12/1995 | Murray et al. | 100/332 |
| 5,849,388 A | * | 12/1998 | Preszler et al. | 34/575 |
| 6,058,626 A | | 5/2000 | De Vroome et al. | |
| 6,146,028 A | * | 11/2000 | Preszler | 34/639 |

FOREIGN PATENT DOCUMENTS

| | | |
|---|---|---|
| DE | 811 946 | 6/1951 |
| DE | 32 07 461 A1 | 9/1983 |
| DE | 44 05 332 A1 | 8/1995 |
| DE | 197 10 124 A1 | 9/1998 |
| DE | 298 19 202 U1 | 3/1999 |
| EP | 0 396 173 B2 | 11/1990 |
| EP | 0 543 439 A1 | 5/1993 |
| EP | 0 658 427 A1 | 6/1995 |
| EP | 0 723 126 A1 | 7/1996 |
| EP | 0 723 126 B1 | 7/1996 |

* cited by examiner

*Primary Examiner*—Jiping Lu
(74) *Attorney, Agent, or Firm*—Laurence A. Greenberg; Werner H. Stemer; Gregory L. Mayback

(57) ABSTRACT

A dryer for a material web having a surface to which ink is applied, including a housing subdivided into sections, through which a web travel plane extends wherein the material web is transportable, and a cooling and conditioning unit integrated in the housing, the cooling and conditioning unit having an inlet for admitting therethrough fresh air to the housing, includes at least one chill roll in the cooling and conditioning unit, over which the material web is guidable, the at least one chill roll being disposed and the fresh air being conductable through the cooling and conditioning unit in a manner for promoting post-evaporation of solvent inside the cooling and conditioning unit, and for preventing solvent vapors harmful to operating personnel from escaping to the outside from the housing; and a method of operating the dryer.

13 Claims, 4 Drawing Sheets

DRYER WITH INTEGRATED COOLING UNIT AND METHOD OF OPERATION

BACKGROUND OF THE INVENTION

FIELD OF THE INVENTION

The invention relates to a dryer with an integrated cooling unit and, more particularly, wherein the cooling unit is disposed downline of a web-processing rotary printing machine; and a method of operating the dryer.

U.S. Pat. No. 5,471,847 discloses a web cooling device. With the improvement disclosed therein, the disadvantages of previous drying concepts are sought to be overcome by is providing for the web to be cooled primarily by the evaporation of a liquid instead of by thermal conduction or convection. In this regard, sufficient moisture remains in the web so that shrinkage of the web does not occur, and static charging of the web is at a minimum. In a dryer for offset printing applications, the web is dried down to 2% residual moisture content and thereby absorbs moisture in an amount leading up to a moisture content of between 4% and 6% from the air surrounding it. This additional moisture uptake from the surroundings is implemented, in accordance with the foregoing U.S. patent, by a moisture application device provided specifically for this purpose.

The published European Patent Document EP 0 723 126 A1 discloses a control device and an arrangement for a drying process performed continuously in an industrial dryer. In a flotation dryer wherein a material web is floatingly guided for drying the web in stages, solvent-containing air recirculates in the interior of the dryer. A method is proposed for improving the control of the solvent-containing air in the interior of the dryer. Condensation of the solvents and various by-products based upon solvents are thereby significantly reduced or even eliminated altogether. By the method disclosed in this reference, not only can a considerable reduction in condensation be achieved, but also more intensive mixing and hence more uniform distribution of the solvents, due to which the safety level as a whole is raised, in the regions wherein solvent-containing air is present in which concentrations are avoided entirely. Ambient air passes into the dryer and is mixed with the solvent-containing air in the interior of the dryer. The air mixture is fed back to the first zone of the dryer in accordance with this European patent document. As a result, the open flame of the burner is cooled from the outside by ambient air. After the open flame has been cooled by ambient air, recirculated air from the interior of the dryer is mixed with the fresh air. In the improved process described in the European patent document, the volume of the exhaust gas passing to a recombustion unit that may be present is not reduced significantly. In the disclosed embodiment, ambient air is employed for the purpose of cooling the open burner flame and of eliminating undesired compounds of organic volatile constituents. In the improvement according to this European patent document, the residence time of the combustion mixture in the burner unit appears to be dimensioned inadequately.

The published German Patent Document DE 32 07 461 A1 is concerned with a method and a device for drying and subsequently cooling material webs, in particular, material webs which are printed by the offset printing process. The invention relates to a method according to the offset printing process. After contact-free drying of the printed material web, the web is guided over several chill rolls in an S or Z-shaped path. In this regard, by wetting the circumference of the first chill roll underneath that side of the material web that is cooled first, an easily splittable water film is applied between the material web and the jacket or casing of the rolls. A result of this measure is that the yet soft thermoplastic printing ink is not split during the bodily contact between the material web and this and the other chill rolls. The tendency of the material web to form waves transversely to the pass-through direction is reduced, because the splitting of the water film as a consequence of the different thickness thereof in the printed and the nonprinted and therefore highly dried regions leads to a uniform moisture distribution.

In the proposed solution according to the published German Patent Document DE 197 10 124 A1, a method and a device for controlling the temperature of chill rolls are disclosed. This proposal is concerned with a method and a device for cooling a printed or coated material web, which in particular has been printed by the offset printing process and is formed of paper. After the application of ink, the material web passes through a heating zone and is guided over a multiplicity of chill rolls in a chill-roll stand. In this regard, the flow of the cooling medium or coolant through the chill rolls of a chill-roll stand is produced by two different cooling circuits or circulatory loops at different temperature levels, and is directed over the chill rolls in a direction opposite to the travel direction of a material web.

In the structural embodiment of the last-mentioned German patent application also, the cooling-roll stand is arranged separately from the upline dryer of the rotary printing machine.

Conventional dryer/chill-roll stand configurations have separate dryer housings and separate housings for chill rolls and rewetting units, which are located further downline of the web travel plane. These housings, which are mutually separated, have a significant disadvantage in that problems occurring in one housing cause further problems in the next housing arranged downline thereof, such as, for example, lateral run-out or travel of the material web. Heretofore known cooling-roll stands require a relatively large amount of erection space and, consequently, increase the overall construction length of a web-fed rotary printing machine. In addition, in conventional cooling-roll stand arrangements of the prior art, oil condensation may occur on the surfaces of the first chill rolls of these chill-roll stands.

SUMMARY OF THE INVENTION

In view of the foregoing improvements proposed in the prior art and in conventional dryer/chill-roll stand configurations, and the problems occurring in the technical sector, it is an object of the invention of the instant application to provide a dryer with an integrated cooling unit wherein the disadvantages resident in conventional dryer/chill-roll stand configurations, such as a build-up of ink, lateral run-out or travel of the material web, and the aforementioned condensation problem are eliminated to a great extent.

Another object of the invention is to provide a dryer with an integrated cooling unit of such construction as to reduce the overall length of a rotary printing machine.

A further object of the invention is to provide such a dryer with an integrated cooling unit which avoids exposing the operating personnel of a web-fed machine to post-evaporation or after-vaporization.

Yet another object of the invention is to provide a dryer with an integrated cooling unit which permits the alignment of a folder or a folding apparatus disposed downline of the chill-roll stand to remain independent of the other rotary printing machine components.

With the foregoing and other objects in view, there is thus provided, in accordance with one aspect of the invention, a dryer for a material web having a surface to which ink is applied, including a housing subdivided into sections, through which a web travel plane extends wherein the material web is transportable, and a cooling and conditioning unit integrated in the housing, the cooling and conditioning unit having an inlet for admitting therethrough fresh air to the housing, comprising at least one chill roll in the cooling and conditioning unit, over which the material web is guidable, the at least one chill roll being disposed and the fresh air being conductable through the cooling and conditioning unit in a manner for promoting post-evaporation of solvent inside the cooling and conditioning unit, and for preventing solvent vapors harmful to operating personnel from escaping to the outside from the housing.

In accordance with another feature of the invention, the sections of the housing include a heating section, an evaporation section and a cooling section, and the cooling and conditioning unit being disposed downline of the cooling section in a travel direction of the material web.

In accordance with a further feature of the invention, the fresh air is conductable around the evaporation section to the heating section.

In accordance with an added feature of the invention, the dryer includes connecting pipes for conducting the fresh air to the heating section.

In accordance with an additional feature of the invention, hot air at a higher temperature level is conductable to the heating section, and at least one of the hot air at the higher temperature level and hot air at a lower temperature level is conductable to the cooling section of the dryer.

In accordance with yet another feature of the invention, the air is conductable within the dryer through the sections of the dryer so as to be directed counter to a web travel direction.

In accordance with yet a further feature of the invention, recycled air is exchangeable between the sections of the dryer in the direction counter to the web travel direction.

In accordance with an alternative feature of the invention, recycled air is exchangeable between the sections of the dryer in a web travel direction.

In accordance with yet an added feature of the invention, the at least one chill roll is a first chill roll of a plurality thereof over which the material web is guidable, the first chill roll being disposed near an outlet of the dryer.

In accordance with yet an additional feature of the invention, the at least one chill roll, in the interior thereof, is free of any inserts for deflecting coolant flowing therethrough.

In accordance with another aspect of the invention, there is provided a method of drying a material web that is printed on at least one side thereof and is guidable through a dryer having a housing with a plurality of sections, wherein a cooling and conditioning unit is integrated through which fresh air is admitted, which comprises disposing a plurality of chill rolls in the cooling and conditioning unit, whereover the material web is guided after passing through the sections, and conducting fresh air through the cooling and conditioning unit in a manner for promoting post-evaporation of solvent within the cooling and conditioning unit, and for preventing solvent vapors harmful to operating personnel from escaping to the outside from the housing.

In accordance with another mode of the method, inlet parameters of the material web at the dryer inlet for the material web approximately coincide with the material web parameters at the dryer outlet for the material web.

In accordance with a concomitant mode of the method, the parameters include at least one of the temperature and the moisture content of the material web.

Because the material web, such as a printed paper web, both sides of which are printed, is no longer exposed to the conditions of the surrounding atmosphere between the dryer and the chill-roll frame, the adherence of boundary layers of cold air to both sides of the material web can be prevented. In this way, air cushions between the chill-roll surfaces and the sides of the material web contacting the latter can be avoided, by which oil condensation is also eliminated. Furthermore, by the arrangement according to the invention, sooting at the dryer outlet can be avoided, because the dryer outlet is no longer connected to the surrounding atmosphere, because the chill-roll frame according to the invention of the instant application is integrated in the dryer housing. Fresh air, which is conducted through the cooling and conditioning unit that is integrated in the dryer, also contributes to the post-evaporation or re-evaporation within the combined dryer/cooling-roll frame/conditioning-unit arrangement.

In further developments of the invention of the instant application, the dryer includes a heating zone, an evaporation zone and a cooling zone, which can be separated from one another or in which the heating zone and the evaporation zone are combined with one another and are separated only from the cooling section. Arranged in each of these zones are appropriate upper and lower blowers, which recycle conditioned air, for example hot air supplied from burner units and recirculated air emerging from the nozzle bars, back to the nozzle bars, which extend through the zones of the dryer. In advantageous process-air guidance methods according to the invention of the instant application, process-air and hot-air guidance methods will be described hereinbelow which are suitable for operating a dryer according to the invention of the instant application either in accordance with countercurrent or continuous air guidance principles.

In accordance with a method of treating a material web according to the invention of the instant application, the methods of heating, evaporation, cooling and cooling on a chill-roll stand, combined with one another, all proceed in a common housing, which is encapsulated from the ambient atmosphere surrounding it. A material web entering the arrangement according to the invention of a combined dryer/chill-roll frame housing has, at the entry or inlet thereof, virtually the same entry parameters as the parameters at the outlet thereof, such as the lateral position of the web, the temperature level and the moisture content.

Other features which are considered as characteristic for the invention are set forth in the appended claims.

Although the invention is illustrated and described herein as embodied in a dryer with an integrated cooling unit and method of operation, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
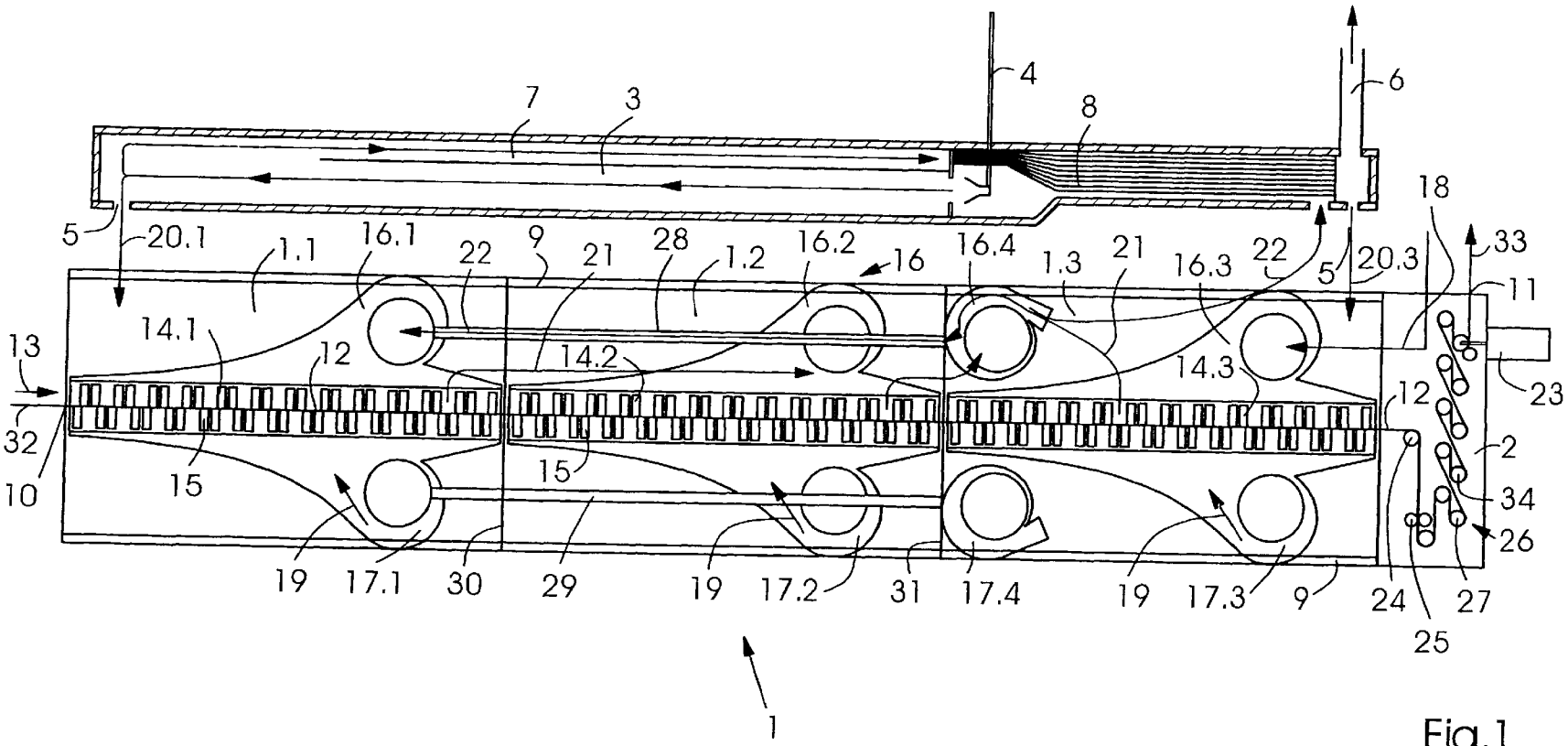
FIG. 1 is a diagrammatic view of a dryer/chill-roll stand arrangement according to the invention of the instant application, a burner unit being provided, for example, on the outside of a housing for the dryer/chill-roll stand.

Referring now to the drawings and, first, particularly to FIG. 1 thereof, there is shown therein a dryer/chill-roll stand configuration according to the invention of the instant application, a burner unit being accommodated on the outside of the dryer.

In the embodiment illustrated in FIG. 1, a dryer 1 has a first section 1.1, a second section 1.2 and a third section 1.3. Arranged directly downline of the third section 1.3 is a cooling/conditioning unit 2. The first section 1.1 is designated as a heating zone in the dryer 1, hot air represented by the arrow 19 being fed to nozzles 14.1 therein. The second section 1.2 is viewed as a solvent-evaporating or vaporizing section within the dryer 1, wherein the highest concentration of solvents prevails and wherein there is the highest negative pressure gradient. The third section 1.3 of the dryer 1 is a section called the cooling zone, wherein, however, temperatures higher than 150° C. still occur. Directly downline of the cooling section 1.3, a cooling/conditioning unit 2 is integrated into a housing 9 of the dryer 1, a material web, for example, a printed paper web assuming a substantially vertically oriented web travel path indicated by the reference numeral 26.

In the arrangement according to FIG. 1, a burner unit 3 is arranged outside the dryer housing 9 and can, if required, contain a recombustion device and an appropriate heat exchanger 8, which is represented only diagrammatically in and is located on the right-hand side of the burner unit 3 in FIG. 1. Arranged above the burner unit 3 is a gas feed 4, the burner unit 3 containing two hot-air outlets 5, through which hot air 20 can be conducted into the interior of the dryer housing 9. Arranged inside the burner unit 3 is a pipe 7 which permits the recirculation of the combustion gases. The housing 9 of the dryer 1 is formed with a dryer inlet 10 and a dryer outlet 11, the dryer outlet 11 in the exemplary embodiment illustrated in FIG. 1 extending substantially in the vertical direction and being arranged at the outlet of the cooling/conditioning unit 2 that is integrated into the dryer housing 9. Alternatively, the web can leave the cooling and conditioning unit 2 in a horizontal direction as well, after appropriate deflection. The material web, which may be printed on both sides, passes through the dryer housing 9 in a substantially horizontal material-web conveying plane 12 extending between upper nozzle bars 14 and lower nozzle bars 15. In the exemplary embodiment illustrated in FIG. 1, hot air 20.1 emerging from the burner unit 3 is conducted into the first section heating zone 1.1 via the hot-gas outlet 5.

Accommodated within the dryer housing 9 is an upper row of blowers 16. A first upper blower 16.1 guides the hot air represented by the arrow 19 to the region of the upper nozzle-bar rows 14.1 extending through the first dryer section 1.1. Arranged within the next dryer section 1.2 is a further upper blower 16.2, to which recycled air represented by the arrow 21 is fed. Hot air represented by the arrow 20.1 which is at a higher temperature level of about 800° C. is fed to the first blower 16.1 and conducted by the latter to the upper nozzle-bar rows 14.1 of the first dryer section 1.1. The highest solvent concentration and the highest negative pressure gradient prevail in the evaporation or vaporizer section 1.2 of the dryer 1. In the exemplary embodiment of FIG. 1, the first dryer section 1.1. and the adjacent second dryer section 1.2 are separated from one another by a separating element or baffle 30 which, however, is formed with openings for the passage therethrough of connecting pipes 28 and 29, as well as openings for permitting the recycled air 21 to flow over from the first section 1.1 into the downline second section 1.2 because of the pressure drop therebetween. Provided downline of the second dryer section 1.2 is a third dryer section 1.3. Two blowers 16.3 and 16.4 are accommodated in the third dryer section 1.3, of which one is an upper, third blower 16.3, to which fresh air 18 with ambient air parameters is fed. Some of the recycled air 21 is also fed to the third dryer section 1.3, which is considered to be a cooling zone. More specifically, via the other blower 16.4 provided in the third dryer section, the recycled air 21 from the upper nozzle-bar row 14.2 of the second dryer section 1.2 is fed to the exhaust-gas line 6, downline from which a recombustion or afterburner device may optionally be arranged. Recycled air 21 from the nozzle-bar row 14.3 of the cooling zone of the dryer, i.e., the section 1.3, is conducted to the first dryer section 1.1 by the connecting pipes 28 and 29.

It is thus possible for cleaning air 22, which was previously recycled air 21 from the evaporation or vaporization zone, i.e. the dryer section 1.1, to be fed either to the optionally provided recombustion or afterburner device or to pass directly into the exhaust-gas line itself. That which applied to the dryer sections 1.1, 1.2 and 1.3 in relation to the upper nozzle-bar rows 14.1, 14.2 and 14.3 applies in substance to the lower nozzle rows 15.1, 15.2 and 15.3 as well, and therefore does not have to be repeated. In a similar manner, in the lower half of the dryer 1, a first, second and third blower 17.1, 17.2 and 17.3 are likewise provided and likewise assigned to the individual dryer sections 1.1, 1.2 and 1.3, respectively.

Downline of the dryer section 1.3, a cooling and conditioning unit 2 is integrated into the housing 9 of the dryer 1. The material web leaving the third zone 1.3 of the dryer 1 enters the cooling and conditioning unit 2 directly from the dryer 1, without having been exposed to the ambient air outside the dryer housing 9. The material web, which leaves the cooling and conditioning unit 2 of the dryer 1 at the outlet 11, has web parameters 33 thereat which include a temperature of about 30° C. and a moisture content of 4% $H_2O$. This essentially corresponds to the same entry conditions 32 with which the material web enters the dryer 1, specifically a temperature of 30° C. at the inlet to the dryer 1, but a somewhat higher moisture content of about 6% $H_2O$. As is also apparent from FIG. 1, the last of the chill rolls 27 can have a separate drive unit 23, in order to ensure a correct entry of the web leaving the cooling and conditioning unit 2 into the angle-bar superstructure arranged downline.

By virtue of the immediate entry of the web into the cooling and conditioning unit 2, oil condensation on the surfaces of the first chill rolls is prevented, because no spacing exists between the dryer outlet and the entry or inlet to the cooling and conditioning unit 2. The occurrence of post-evaporation or post-vaporization can be shifted into the housing 9 of the cooling and conditioning unit 2, because fresh air 18 is continuously conducted through the latter, and promotes the post-evaporation within the housing 9, so that the personnel operating the rotary machine are not exposed to any post-evaporation or to solvents evaporating from volatile constituents.

In addition, combining the related processes of drying, cooling and re-moistening of a material web within one housing means that the process can be managed in such a way that the web specifications at the entry or inlet to the housing and the outlet from this housing essentially coincide. Thus, the temperature of the material web at the inlet has approximately the same value as at the outlet 11 (approximately 30° C.); the lateral position of the material web essentially coincides at the dryer inlet 10 and at the dryer outlet 11, and finally the moisture content of the material web, namely 6% $H_2O$ at the dryer inlet, is at approximately the same level as the moisture content of the material web at the dryer outlet 11. Another advantage associated with the configuration according to the invention resides in the fact that integrating the cooling and conditioning unit 2 into the housing 9 of the dryer means that the overall length of a rotary machine can be kept significantly shorter, so that significantly less erection space is required within a printing shop or plant.

Figure 2:
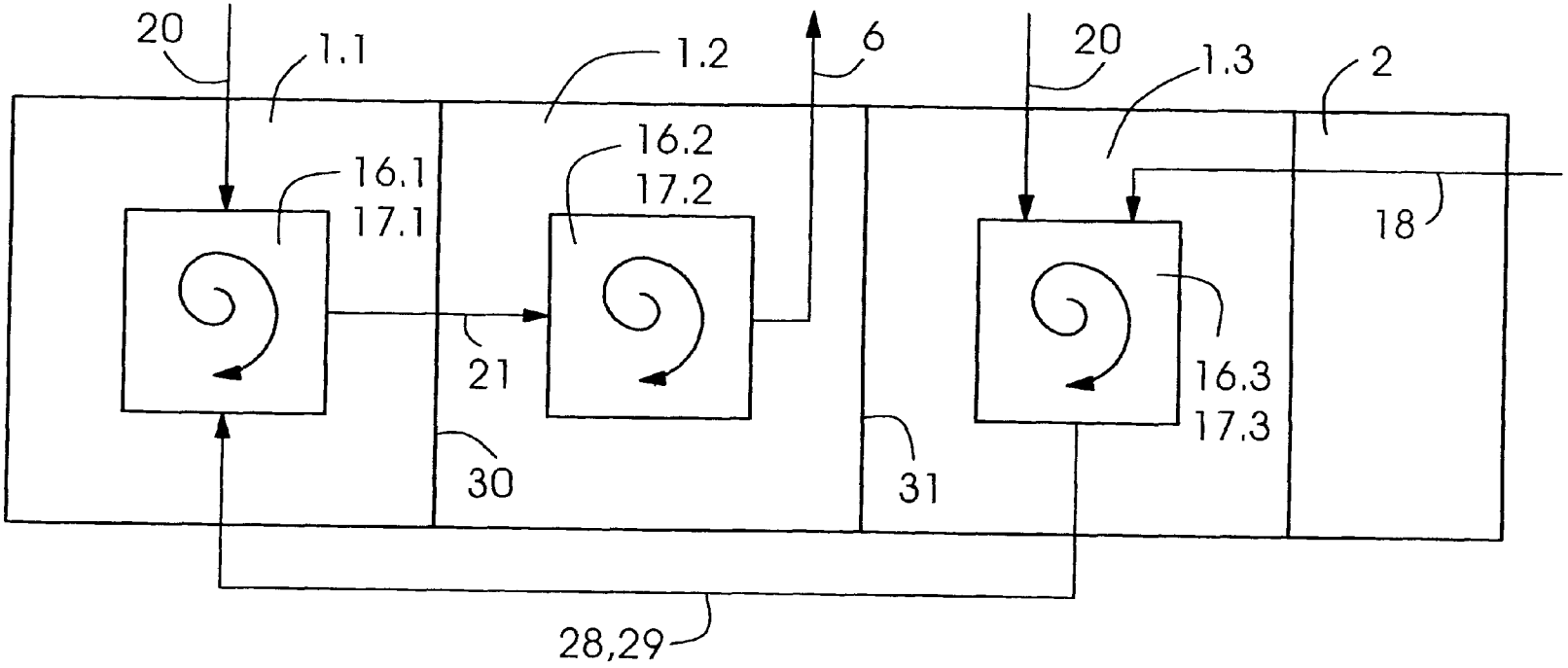
FIG. 2 is a schematic view of air guidance within a dryer according to the invention of the instant application, process air being conducted through one of the dryer sections.

FIG. 2 is a schematic view of air guidance within a dryer according to the invention of the instant application, wherein process air is guided around one section of the dryer.

In this configuration, hot gas 20 and process air 18 are fed through the connecting-pipe system 28, 29 to the dryer section 1.1 by the blower arrangement 16.3, 17.3 disposed within the dryer section 1.3. The connecting-pipe system 28, 29 can be accommodated, for example, within the dryer housing 9. Hot gas 20 can likewise be fed to the first dryer section 1.1, as can be seen in the air guidance schematic according to FIG. 2. By means of the blower arrangement 16.1, 17.1 shown diagrammatically and schematically in FIG. 2, the hot gas 20 and the air/gas mixture, which is fed into the first dryer section 1.1 via the connecting-pipe system 28, 29, are guided to nozzle rows, which are arranged on both sides of the web transport plane and permit a floating transport of these material webs. Recycled air 21 from the nozzle rows in the first dryer section 1.1 is fed to an evaporation or vaporizing section 1.2 through an opening in the separating element or partition 30, which may be provided between the first and the second dryer sections 1.1 and 1.2, respectively. As an alternative thereto, the separating element 30 may also be omitted in order to ensure the flow-over of the recycled air 21 into the evaporation or vaporization section 1.2 of the dryer 1 without hindrance from the nozzle rows of the first dryer section 1.1 of the dryer 1. In the second section 1.2 of the dryer 1, i.e., the section 1.2 that drives the solvents out, the highest negative pressure gradient and the highest solvent concentration prevail therein. For this reason, the second section 1.2 of the dryer 1 has an exhaust-gas line 6 assigned thereto, in order to feed the exhaust gas to a recombustion or afterburning unit that may optionally be provided outside the dryer 1.

The blower arrangement 16.2 and 17.2, respectively, within the second dryer zone 1.2 distributes the recycled air 21 to the corresponding nozzle-row sections within the section 1.2 for driving solvents out that has already been described herein briefly in connection with FIG. 1.

Figure 3:
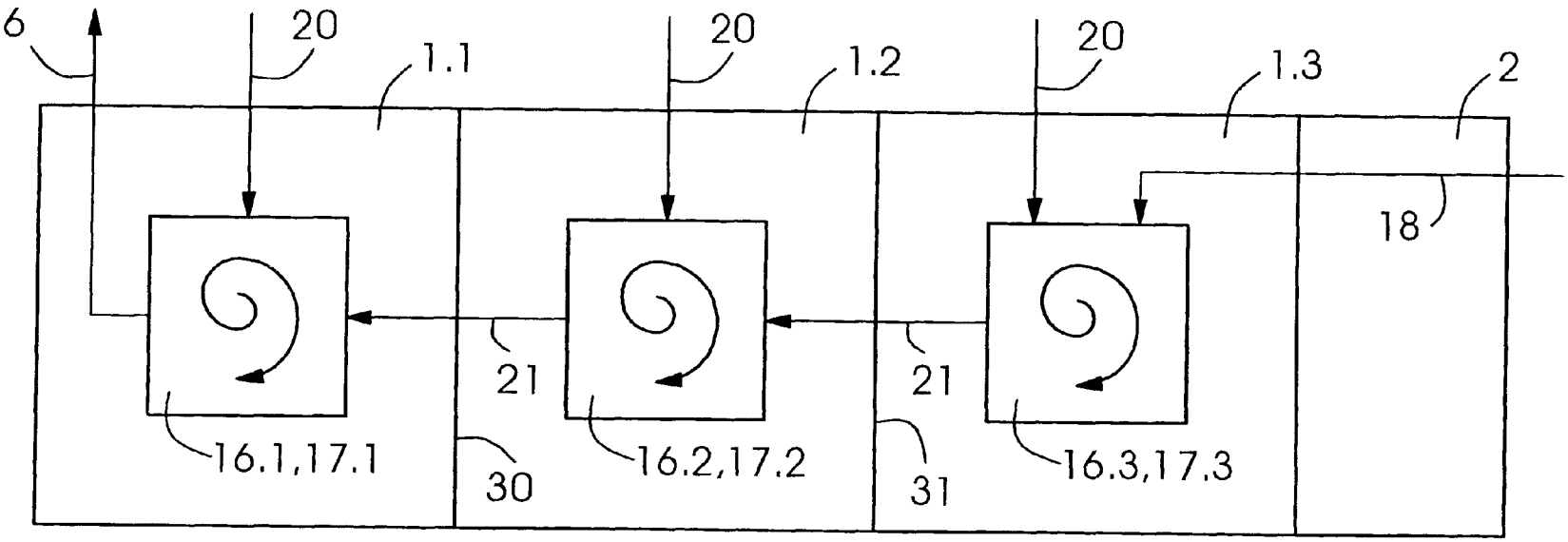
FIG. 3 is a schematic view of air guidance of a dryer according to the invention of the instant application, the dryer being operated in accordance with the countercurrent principle.

FIG. 3 shows an alternative air guidance schematic within a dryer 1 according to the invention of the instant application, the dryer 1 being operated in a countercurrent mode.

As has already been described in connection with FIG. 2, hot gas 20 from a burner unit 3, and process air 18 are fed to a blower pair 16.3, 17.3 within the third dryer section 1.3. Recycled air 21 is then transported, in accordance with the countercurrent principle relative to the web transport direction, from the third dryer section 1.3, through the evaporation zone 1.2 of the dryer 1, and into the heating zone 1.1. Hot gas 20 is respectively fed individually to the blower arrangements 16.3, 17.3; 16.2, 17.2; 16.1, 17.1. As it passes through the various dryer sections 1.1, 1.2 and 1.3, the recycled air 21 gradually increases the solvent content thereof, particularly within the evaporation zone 1.2. Because the highest solvent concentration of the air in the dryer 1 is attained within the first section 1.1 of the dryer 1 when the countercurrent principle is applied, an exhaust-gas line 6 is assigned to the zone 1.1, in order to feed the solvent-laden exhaust gases to a recombustion device inside or outside the dryer 1.

Because of the pressure difference prevailing between the cooling section 1.3 and the evaporation section 1.2, a separating element 31 is provided between these zones in the embodiment according to FIG. 3. Formed in this separating element 31 is an opening permitting recycled air 21 to flow into the evaporation section 1.2. The separating element 30 illustrated in FIG. 3 for separating the first and the second dryer sections 1.1 and 1.2, respectively, from one another is not absolutely necessary for separating the sections 1.1 and 1.2 from one another, and can also be omitted.

Figure 4:
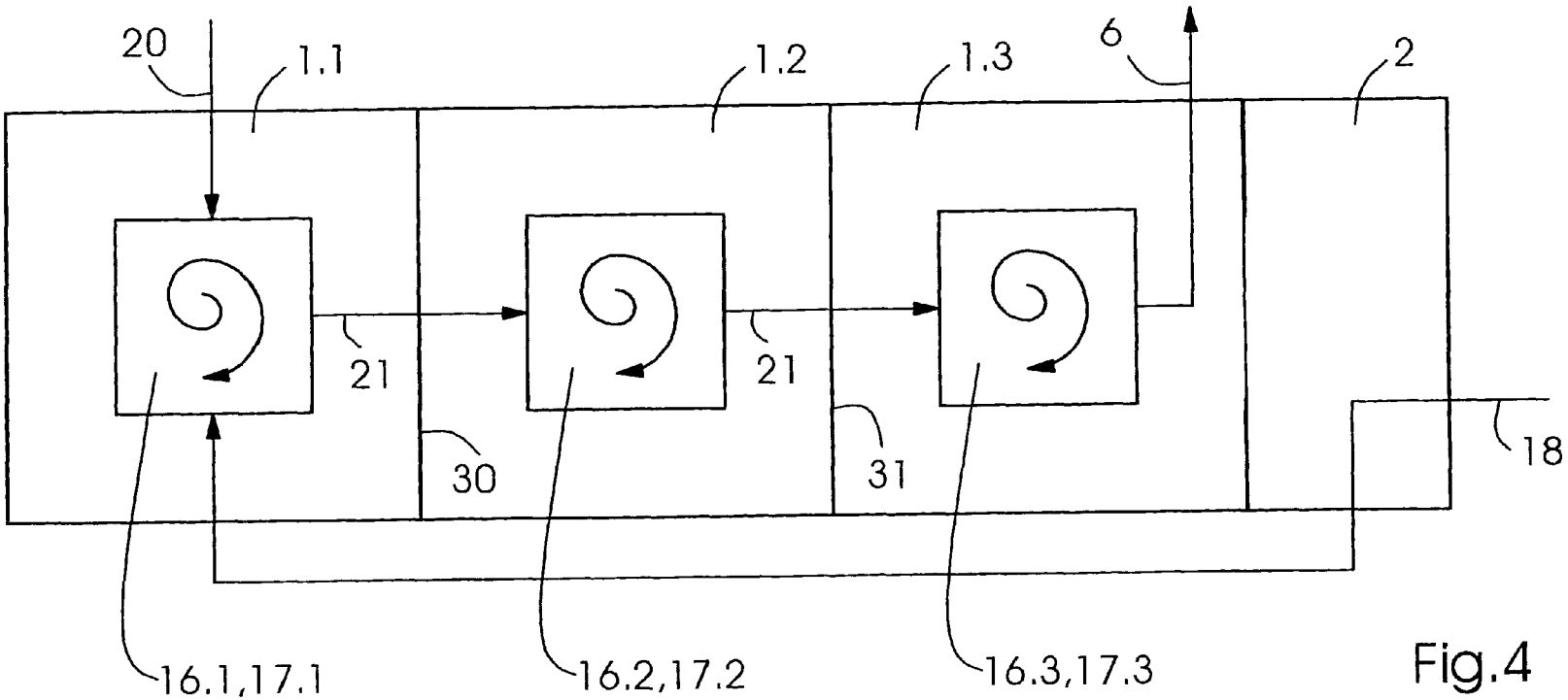
FIG. 4 is a schematic view of air guidance for a dryer according to the invention of the instant application, which is operated in accordance with the unidirectional current principle.

FIG. 4 shows an air guidance schematic for a dryer 1 according to the invention which is operated in a continuous flow mode.

In this configuration, hot gas 20 and ambient air 18 are fed to the first dryer section 1.1 from the outside. Arranged within the first dryer section 1.1, that is to say the heating zone, is a blower arrangement 16.1, 17.1, which ensures the distribution of the hot-gas/air mixture in the web running plane. Recycled air 21 from the aforementioned blower arrangement 16.1, 17.1 is led into an evaporation section 1.2 through a separating element 30 that may optionally be provided. This separating element 30 may also be omitted, in order to ensure free flow-through of the recycled air 21 into the evaporation section 1.2 of the dryer 1.

From the evaporation section 1.2 of the dryer 1, recycled air 21, then containing solvent because of the evaporation process taking place therein, passes into the dryer section 1.3, which may be separated from the evaporation section 1.2 of the dryer 1 by a separating element 31. During the transport of the recycled air 21 through the various dryer sections 1.1, 1.2 and 1.3, the recycled air 21 retains more and more solvent, the highest solvent concentration thereof being reached in the last zone 1.3. Consequently, an exhaust-gas line 6 is assigned to this third dryer section 1.3, which may be separated from the evaporation zone 1.2 of the dryer 1, because of the high pressure difference, by an aforementioned separating element 31.

In the configuration according to FIG. 4, the air guidance is kept substantially parallel to the web travel direction. All three air guidance schematics of FIGS. 2, 3 and 4 offer the advantage that the fresh-air flow through the cooling and conditioning unit 2, which is arranged downline of the dryer 1 and is integrated into the housing 9 thereof, contributes to the further evaporation within the cooling and conditioning unit 2, regardless of whether the process-air flow 18 passes through this cooling and conditioning unit 2 in an upper section or in a lower section.

I claim:

1. A dryer for a material web having a surface to which ink is applied, including a housing subdivided into sections, through which a web travel plane extends wherein the material web is transportable, and a cooling and conditioning unit integrated in the housing, the cooling and conditioning unit having an inlet for admitting therethrough fresh air to the housing, comprising at least one chill roll in the cooling and conditioning unit, over which the material web is guidable, the at least one chill roll being disposed and the fresh air being conductable through the cooling and conditioning unit in a manner for promoting post-evaporation of solvent inside the cooling and conditioning unit, and for preventing solvent vapors harmful to operating personnel from escaping to the outside from the housing.

2. The dryer according to claim 1, wherein the sections of the housing include a heating section, an evaporation section and a cooling section, and the cooling and conditioning unit being disposed downline of the cooling section in a travel direction of the material web.

3. The dryer according to claim 2, wherein the fresh air is conductable around said evaporation section to said heating section.

4. The dryer according to claim 3, including connecting pipes for conducting the fresh air to said heating section.

5. The dryer according to claim 2, wherein hot air at a higher temperature level is conductable to said heating section, and at least one of the hot air at the higher temperature level and hot air at a lower temperature level is conductable to said cooling section of the dryer.

6. The dryer according to claim 1, wherein the air is conductable within the dryer through the sections of the dryer so as to be directed counter to a web travel direction.

7. The dryer according to claim 6, wherein recycled air is exchangeable between the sections of the dryer in the direction counter to the web travel direction.

8. The dryer according to claim 1, wherein recycled air is exchangeable between the sections of the dryer in a web travel direction.

9. The dryer according to claim 1, wherein the at least one chill roll is a first chill roll of a plurality thereof over which the material web is guidable, said first chill roll being disposed near an outlet of the dryer.

10. The dryer according to claim 1, wherein the at least one chill roll, in the interior thereof, is free of any inserts for deflecting coolant flowing therethrough.

11. A method of drying a material web that is printed on at least one side thereof and is guidable through a dryer having a housing with a plurality of sections, wherein a cooling and conditioning unit is integrated through which fresh air is admitted, which comprises disposing a plurality of chill rolls in the cooling and conditioning unit, whereover the material web is guided after passing through the sections, and conducting fresh air through the cooling and conditioning unit in a manner for promoting post-evaporation of solvent within the cooling and conditioning unit, and for preventing solvent vapors harmful to operating personnel from escaping to the outside from the housing.

12. The method according to claim 11, wherein inlet parameters of the material web at the dryer inlet for the material web approximately coincide with the material web parameters at the dryer outlet for the material web.

13. The method according to claim 12, wherein the parameters include at least one of the temperature and the moisture content of the material web.

* * * * *